United States Patent [19]

Chapman et al.

[11] 4,246,847

[45] Jan. 27, 1981

[54] BUMPER ASSISTED FOR CART ACCUMULATOR

[75] Inventors: Walter H. Chapman, Beachwood, N.J.; David E. Hiland, Seaford, Del.; Erwin B. Knies, Norristown, Pa.

[73] Assignee: E. I. Du Pont de Nemours and Company, Wilmington, Del.

[21] Appl. No.: 953,190

[22] Filed: Oct. 20, 1978

[51] Int. Cl.[3] ..... B61B 13/12

[52] U.S. Cl. ..... 104/172 BT

[58] Field of Search ..... 104/172 R, 172 B, 172 BT, 104/170, 178, 130; 180/91, 92, 93; 74/106, 110, 520

[56] References Cited

U.S. PATENT DOCUMENTS

| | | | |
|---|---|---|---|
| 3,015,284 | 1/1962 | Klamp | 104/172 BT |
| 3,291,070 | 12/1966 | Bradt et al. | 104/172 BT |
| 3,295,462 | 1/1967 | Bradt | 104/172 BT |
| 3,338,181 | 8/1967 | Dorrance | 104/172 BT |
| 3,478,697 | 11/1969 | Bradt | 104/172 BT |
| 3,478,698 | 11/1969 | Jones | 104/172 BT |
| 3,675,587 | 7/1972 | Zetterlund et al. | 104/172 BT |
| 3,973,503 | 8/1976 | Parker et al. | 104/172 BT |

*Primary Examiner*—Richard A. Bertsch

[57] ABSTRACT

An apparatus for transmitting force between a wheeled cart and an in-floor conveyor chain that includes a pin mounted on the cart which pivots out of engagement with the chain when a predetermined thrust is exceeded. A bumper connected to the pin via a resilient link assists the pin in retracting from engagement with the chain when the bumper strikes an obstacle in the path of the cart.

9 Claims, 7 Drawing Figures

10
15
14
23
16
20
25
20a
20b
20c
17
13
19
18a
18b
19b
18
12
10b
10a
11
23a
23b
8
8a
21
24
34
29
30
35
33
33a
32a
31

BUMPER ASSISTED FOR CART ACCUMULATOR

DESCRIPTION

1. TECHNICAL FIELD

This invention relates to a tow line conveyor system for wheeled carts and more particularly to a bumper controlled apparatus for connecting the carts to the conveyor.

2. BACKGROUND ART

Tow line conveyor systems for wheeled carts are known in which a number of carts are driven by a subfloor level conveyor system that is engaged by a pin which extends from a location on the bottom of the cart through a slot in the floor. The subfloor systems usually provide for lifting the pin out of engagement with the conveyor and sometimes a bumper assisted lifting arrangement is provided as disclosed, for example, in U.S. Pat. Nos. 3,295,462 and 3,338,181.

Other tow cart mechanisms as disclosed, for example, in U.S. Pat. Nos. 3,015,284, 3,291,070, 3,789,767 and 3,973,503 employ complex linkage and spring arrangements to: at least partially rotate the pin out of engagement with the conveyor when a connected accumulation bumper encounters an obstruction, provide a shock absorbing effect during pin re-engagement and afford a certain degree of personnel safety protection.

The apparatus of this invention provides a simple bumper assisted rotating pin arrangement which will disengage from the propelling conveyor whenever a sufficient obstructive force is encountered whether or not the bumper is contacted and which will automatically re-engage the conveyor when the obstruction is removed. It also provides quiet multi-cart accumulation and a high degree of personnel safety protection by incorporating a padded roller in the accumulation bumper design.

DISCLOSURE OF THE INVENTION

The apparatus according to the invention is constructed in a system for propelling wheeled carts positioned over the conveyor and adjacent thereto for movement by the conveyor and is an apparatus for transmitting force between the conveyor and the cart. The apparatus comprises a frame attached to the cart between the cart and the conveyor; a hub mounted to the frame on an axis transverse to the movement of the conveyor, said hub having a pin extending from it to act as a force transmitting member between the conveyor and the cart, said pin being slideably mounted to the hub for movement with respect to said axis; a bumper assembly mounted on said cart adjacent said frame for pivotal movement between a first and second position; and a link coupled between said bumper and said hub for transmitting movement from said bumper to said hub, said bumper in said first position placing said pin to act as a force transmitting member between the conveyor and the cart, said bumper, when moving between said first and second positions, transmitting movement to said hub to move said pin out of engagement with the conveyor.

DETAILED DESCRIPTION OF THE ILLUSTRATED EMBODIMENTS

Figures 1, 3, 4, 4A:
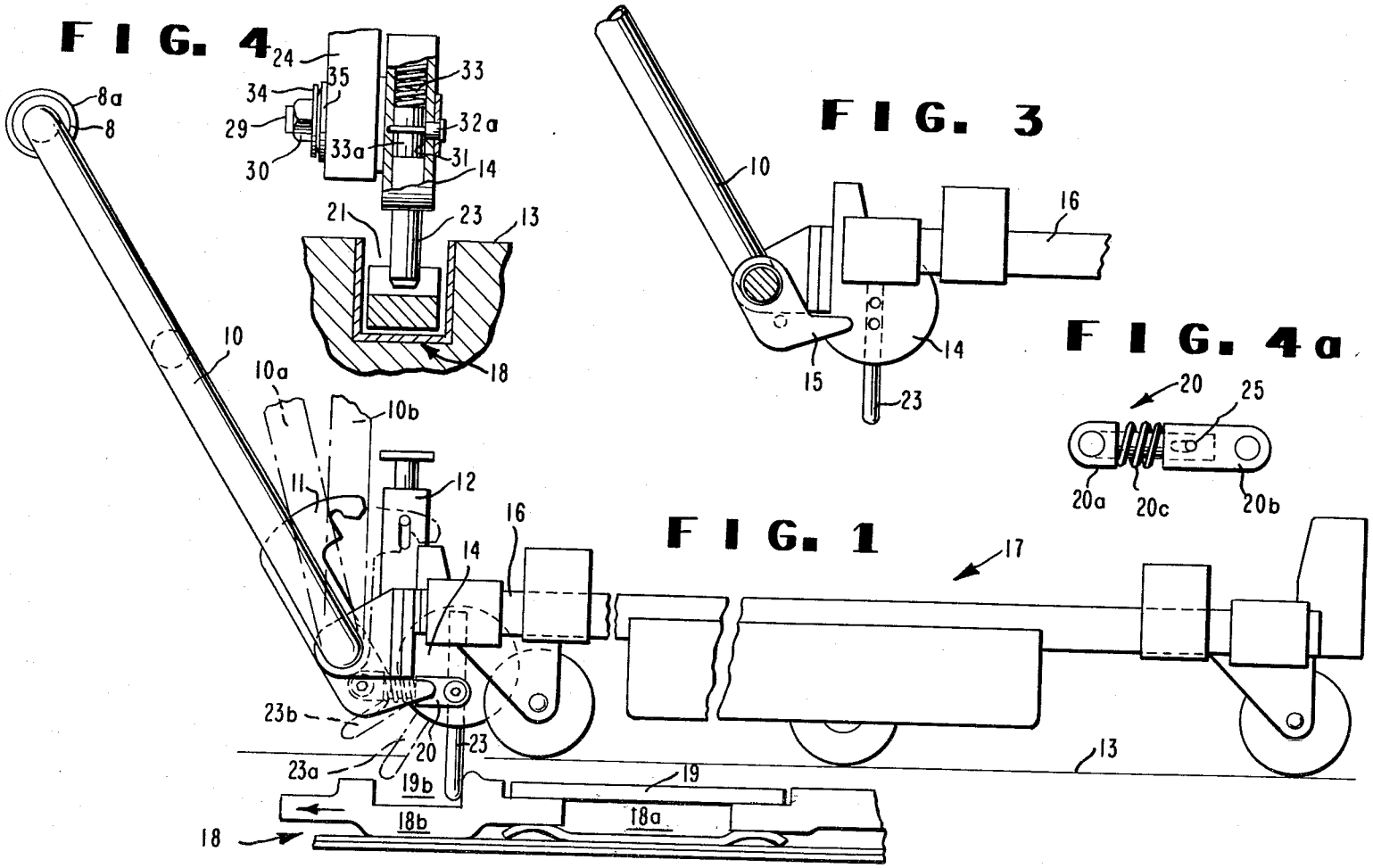
FIG. 1 is a side elevation of a wheeled cart equipped with the apparatus of the present invention engaging a subfloor conveyor.
FIG. 3 is a sectioned view taken along the line 3—3 in FIG. 2.
FIG. 4 is an end view of the hub partially in section.
FIG. 4*a* is a side view of the link between the handle and the hub of the present invention.
Figure 2:
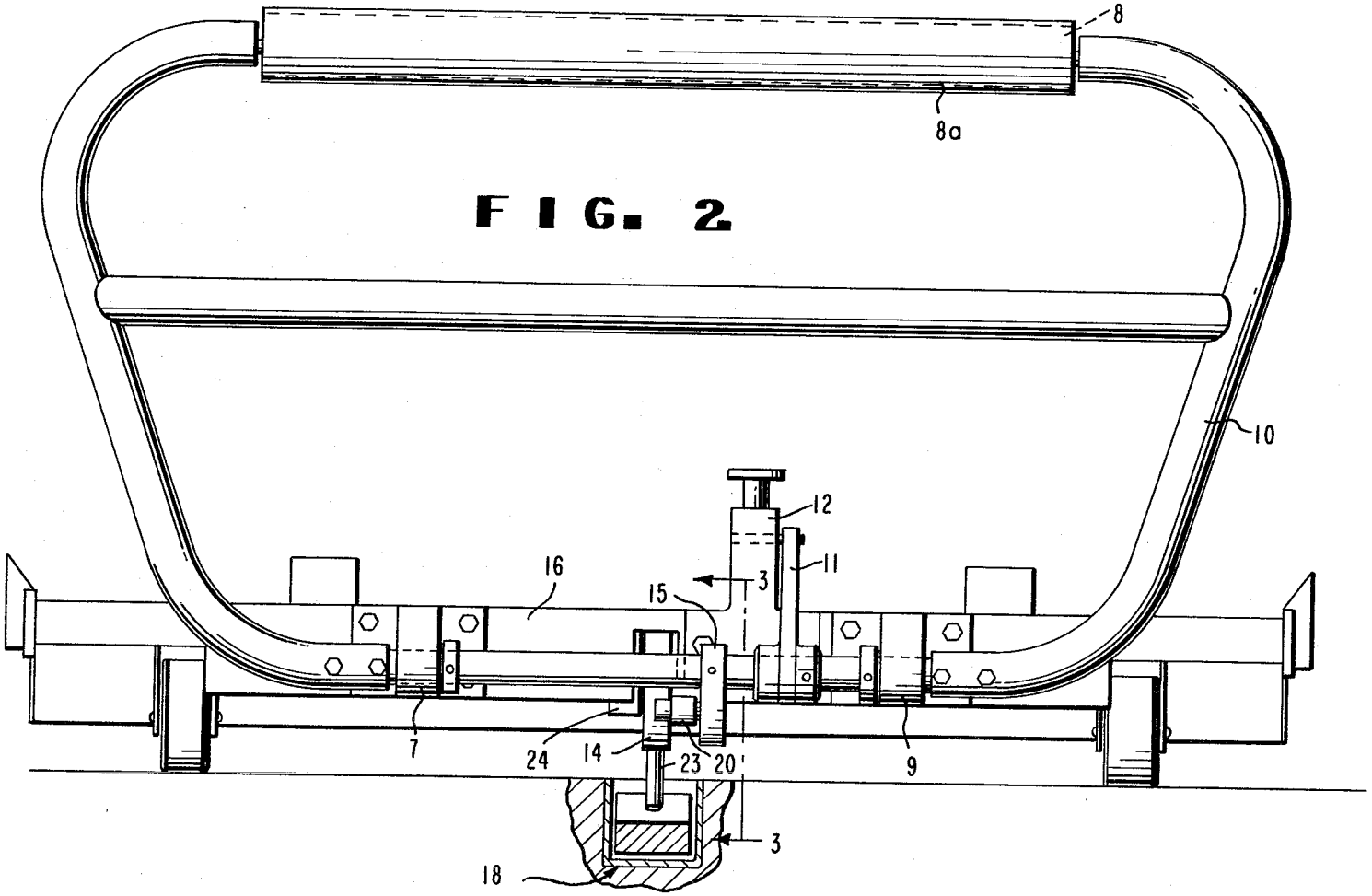
FIG. 2 is a front elevation of the cart of FIG. 1.

Referring to FIGS. 1-4, the apparatus of the invention generally includes a bumper handle 10, a latching mechanism 12 for the bumper handle and a hub 14 rotatable in the frame 16 of wheeled cart 17. The bumper handle is connected to the hub by means of a link 20. The connecting link 20 is attached off center of hub 14 so that movement of handle 10 imparts rotary movement to the hub. The wheeled cart 17 rests on floor 13 having a slot 21 in which the drag chain 18 is moving in the direction shown by the arrow on the chain. Chain 18 consists of two types of alternating links; one type **18*a* has a flat top surface 19 and a second type 18*b* has a depression 19*b* for receiving the pin portion of the hub 14. As best shown in FIG. 4, the hub 14 is mounted on one end of shaft 29 which is rotatable in bracket-like frame 24 and has an axis transverse to the motion of chain 18. Pin 23 is slideable in the bore 31 of hub 14 and is biased outwardly from the hub by a spring 33 positioned behind the pin in the bore of the hub. The pin 23 is retained in the bore by a smaller retaining pin 32*a* engaging the reduced portion 33*a* of the pin 23. On the other end of shaft 29 is a device for regulating the thrust force between the chain and the cart and in this instance the device is a friction clutch comprising a spring washer 34 pressing a friction surface 35 against the outside surface of frame 24. Nut 30 threaded to shaft 29 adjusts the friction force opposing rotation of the hub 14**.

Handle 10, which is pivotally mounted to frame 16 in bearings 7 and 9 includes a roller 8 which can be padded with a foam rubber sleeve **8*a* to effect quiet multi-cart accumulation and enhance personnel safety at one end and an appendage 15 at the other end to engage frame 16 to position the handle 10 and the hub 14 in operating position so that pin 23 is engaged by the chain 18. Link 20 as best shown in FIG. 4*a* is a shock absorbing type of linkage between appendage 15 and the hub 14 and consists of two halves, 20*a*, 20*b* slideably telescoped together and retained as a unit by pin 25 attached to half 20*b* and slideable in the slot in 20*a*. Spring 20*c* serves as a shock absorber when chain 18 abruptly engages pin 23 to insure smooth starts and minimize pin 23** wear.

The handle 10 operates between a first position as shown wherein the weight of the handle places the pin 23 to act as a force transmitting member between the conveyor 18 and the cart 17 and a second position shown in FIG. 1 as **10*b* wherein the handle hook 11 engages latching mechanism 12 positioning the pin in position 23*b* out of engagement with the conveyor 18 and above the floor line 13. This second position frees the cart for movement other than in line with the slot 21 in the floor. In normal operation however, the handle 10 meets an obstacle and is moved to an intermediate position 10*a* rotating pin 23 to position 23*a* after overcoming the combined effect of the counterweighted handle 10 and the force set on friction clutch engaging the hub 14, thus releasing the pin from the conveyor chain 18 and stopping movement of the cart by the chain 18. Single or multiple carts will accumulate in this manner. When the obstacle is removed, the counterweight of the handle pivots it down to its operating position which is fixed by the engagement of appendage 15 with frame 16. During its downward movement handle 10, through link 20, rotates hub 14 to place pin 23 in a vertical position for engagement at link 18***b* of the chain 18. If the pin 23 should come down on the flat top surface 19 of link 18*a*, the pin will move up into hub 14 against spring 33 which will urge the pin into depression 19*b* when link 18*a* is positioned under the pin 23.

If however, an abnormal condition arises where forward progress of the cart is restrained without the handle 10 being contacted, the conveyor will rotate pin 23 out of engagement when the force it exerts exceeds the pre-set resistive force of the friction clutch. Re-engagement will occur automatically when the object restraining the cart's forward movement is removed.

Figure 5:
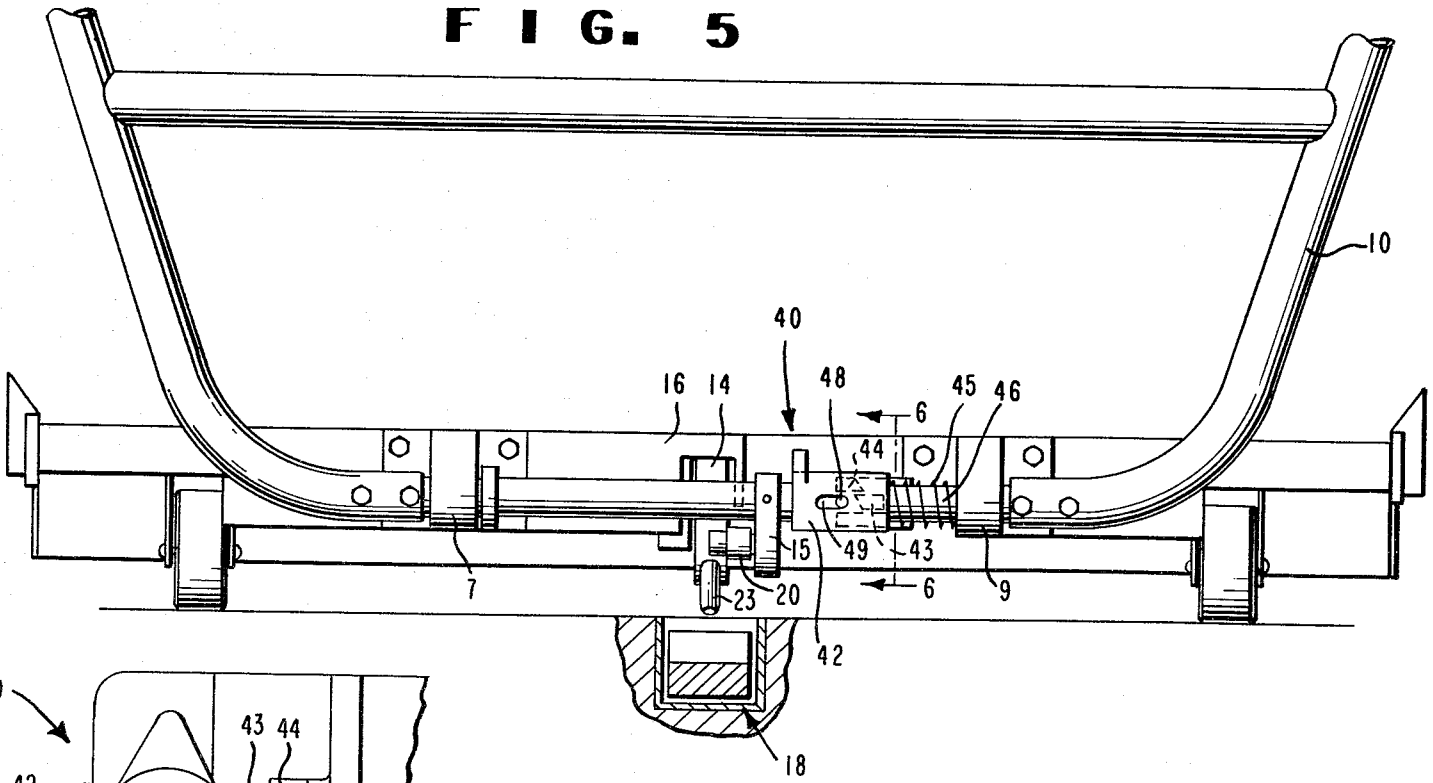
FIG. 5 is a front elevation of an alternate embodiment for the bumper handle latching mechanism.
Figure 6:
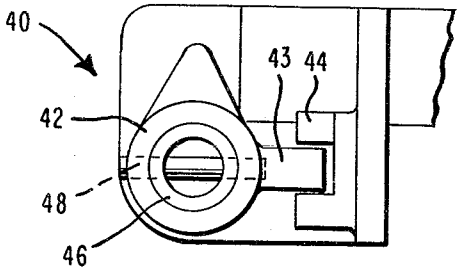
FIG. 6 is a sectioned view taken along line 6—6 of FIG. 5.

In an alternate embodiment a different structured latching mechanism for handle 10 is shown in FIGS. 5 and 6. The latching mechanism 40 includes a sleeve 42 slideable to a limited extent longitudinally on shaft 46 which is attached to handle 10, a lug 43 extending rearward from sleeve 42 and a grooved bracket 44 attached to frame 16 of the cart engaging the lug 43. Sleeve 43 is prevented from rotating independently of the shaft 46 by means of pin 48 through the shaft and the slot 49 in sleeve 43. In the view shown in FIG. 5 the handle 10 is in a latched upright position and pin 23 is at a location shown by 23*b* in FIG. 1. To release the handle 10 from the latched position, sleeve 42 is moved against the spring 45 toward bearing 9 far enough to move lug 43 past bracket 44 and the handle is free to rotate downwardly into the operating position as described above.

While the invention has been disclosed in connection with a cart on a floor, the principles of the invention are considered to be applicable as well to a suspended cart system.

We claim:

1. In a system for propelling wheeled carts, that includes a moving conveyor below a floor and a wheeled cart positioned on the floor over said conveyor and adjacent thereto for movement by said conveyor, an apparatus for transmitting force between said conveyor and said cart, said apparatus comprising: a frame attached to said cart between the cart and the conveyor; a hub rotatably mounted to said frame on an axis transverse to the movement of the conveyor, said hub having a pin extending from it to act as a force transmitting member between the conveyor and the cart, said pin being slideably mounted to the hub for slideable movement within said hub with respect to said axis; a bumper assembly mounted on said cart adjacent said frame for pivotal movement between a first position and a second position; and a link coupled between said bumper assembly and said hub for transmitting movement from said bumper to said hub, said bumper in said first position placing said pin to act as a force transmitting member between the conveyor and the cart, said bumper when moving between said first and second positions transmitting rotary movement to said hub to rotate said pin out of engagement with said conveyor.

2. The system as defined in claim 1 including means for releasably latching said bumper in said second position to position said pin above said floor.

3. The apparatus as defined in claim 1 including means for urging said pin away from said axis and stop means for retaining said pin in said hub.

4. The apparatus as defined in claim 1 including means for applying a predetermined force to said hub to resist movement of said hub.

5. In a system for propellling wheeled carts, that includes a moving conveyor below a floor and a wheeled cart positioned on the floor over said conveyor and adjacent thereto for movement by said conveyor, an apparatus for transmitting force between said conveyor and said cart, said apparatus comprising: a frame attached to said cart between the cart and the conveyor; a hub rotatably mounted to said frame on an axis transverse to the movement of the conveyor, said hub having a pin extending from it to act as a force transmitting member between the conveyor and the cart, said pin being slideably mounted to the hub for movement with respect to said axis; means for applying a predetermined force to said hub to resist rotary movement of said hub; a bumper assembly mounted on said cart adjacent said frame for pivotal movement between a first position and a second position; and a link coupled between said bumper assembly and an off center location on said hub for transmitting rotary movement to said hub, said bumper in said first position placing said pin to act as a force transmitting member between the conveyor and the cart, said bumper when moving between said first and second positions transmitting rotary movement to said hub to move said pin out of engagement with said conveyor.

6. The system as defined in claim 5 including means for releasably latching said bumper in said second position to position said pin above said floor.

7. The apparatus as defined in claim 5 including means for urging said pin away from said axis and stop means for retaining said pin in said hub.

8. The apparatus as defined in claim 5 wherein said link is resilient.

9. The apparatus as defined in claim 5 including a padded roller rotatably mounted to said bumper.

* * * * *